US006690333B2

(12) United States Patent
Eiges

(10) Patent No.: US 6,690,333 B2
(45) Date of Patent: Feb. 10, 2004

(54) CYLINDRICAL RAY IMAGING STEERED BEAM ARRAY (CRISBA) ANTENNA

(75) Inventor: Ron Eiges, Haifa (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 10/135,366

(22) Filed: May 1, 2002

(65) Prior Publication Data

US 2002/0163480 A1 Nov. 7, 2002

(30) Foreign Application Priority Data

May 7, 2001 (IL) ..... 143005

(51) Int. Cl.[7] ..... H01Q 15/08
(52) U.S. Cl. ..... 343/757; 754/761
(58) Field of Search ..... 343/757, 754, 343/761, 911 R, 911 L, 755

(56) References Cited

U.S. PATENT DOCUMENTS 5,781,163 A * 7/1998 Ricardi et al. ..... 343/911 R

OTHER PUBLICATIONS

DBS–2400 In flight TV Antenna System Product Information Sheet, Datron/Tranasco Inc 200 West Los Angeles Ave, Simi Valley CA 93065.
Luneberg RK "Mathematical Theory of Optics" Brown University Press, Providence 1944, pp 189–213.
Ruze J "Wide–angle metal–plate optics" Proceedings of IRE vol 38 pp53–58 Jan. 1950.
Rotman et al "Wide–angle lens for line source applications" IEEE Transactions on Antennas and Propagation vol AP–11, pp 623–632 Nov. 1963.
Hansen RC "Microwave scanning antennas" vol 1 Academic Press NY 1963.
Barlevy et al "Characterization of Electromagnetic Band–Gaps Composed of Multiple Periodic Tripods with Interconnecting Vias: Concept, Analysis and Design" IEEE Transactions on Antennas and Propagation, vol AP–49, pp 343–344 Mar. 2001.
Archer D. "Lens fed multiple beam arrays" Electronics Progress Raytheon vol. XVI, No. 4 pp 24–32 Winter 1974.

* cited by examiner

*Primary Examiner*—James Clinger
(74) *Attorney, Agent, or Firm*—Mark M. Friedman

(57) ABSTRACT

A cylindrical, ray-imaging, electronically steered array antenna, whose radiating array elements are disposed on a cylindrical surface sector above an electrically conductive ground plane that enhances the antenna gain. The conductive ground plane forms an integral part of the antenna, and the required dimensions of this ground plane depend on the array radius, and on the lowest elevation coverage angle from the (possibly tilted) ground plane. The antenna of the present invention is further characterized by a modular design that tailors the required antenna gain and azimuthal directivity through the stacking of identical antenna segments side by side. The antenna design uses the multiple-beam ray focusing property of a microwave lens when feeding a circular ring array, while producing at the same time coherent ray imaging from a bottom metal plate.

38 Claims, 10 Drawing Sheets

CYLINDRICAL RAY IMAGING STEERED BEAM ARRAY (CRISBA) ANTENNA

FIELD AND BACKGROUND OF THE INVENTION

The present invention relates to antennas, specifically electronically steered antennas. In comparison with a mechanically gimbaled antenna, an electronically steered antenna is potentially more immune to critical failures (no moving parts, graceful degradation by failing components) and may more easily be constrained in dimensions. However, depending on its complexity (e.g. number of scan axes), an electronically steered antenna is typically characterized by medium to high cost. When either antenna is mounted over a large metal ground plane such as the top of a passenger airplane, close to grazing-angle antenna beams (low-elevation beams in the case of a top-mounted aircraft antenna) will be adversely affected by scattering from the platform, degrading the free-space performance of the antenna.

Several types of antennas make use of the platform body (or of a separate metal plate parallel to the platform) in order to generate a far-field beam pattern that peaks at a low elevation angle above the ground plane. Noteworthy examples include monopole antennas, blade antennas and ground-plane reflected dielectric rod antennas. These antennas are, however, non-steerable and provide fixed polarization. One notable exception is a Luneberg hemispherical lens antenna sitting on top of a metal-plane plate, as shown for example in "DBS-2400 In-Flight TV Antenna System", Product Information Sheet, Datron/Transco Inc., 200 West Los Angeles Avenue, Simi Valley, Calif. 93065 (hereinafter DBS2400). Beam steering for this antenna is effected by mechanical rotation of its metal-plane plate in azimuth, and angular placement of a feed element in elevation. Control of the feed element polarization directly determines the antenna polarization. Gain enhancement of the DBS2400 antenna is achieved by virtue of reflection from the ground plane, as well as by the arraying of 4 Luneberg hemispherical lenses.

A Luneberg hemispherical lens may be used for the implementation of an electronically steered antenna unit by the incorporation of a switch network that selects one or a group of adjacent feed elements from a concave feed array that partially covers the hemispherical Luneberg lens. Several such antenna units (3 to 4) would be needed for full azimuth coverage, but this will not allow the arrayed combination of several hemispherical lenses for gain enhancement (DBS-2400).

There is thus a widely recognized need for, and it would be highly advantageous to have, a low-profile, cost-effective, polarization-controlled, electronically steered antenna that achieves modularly tailored high directive gain at low elevation angles above a large ground plane on top of which it is mounted.

SUMMARY OF THE INVENTION

The present invention discloses an innovative cylindrical, ray-imaging, electronically-steered array antenna, whose radiating array elements are disposed on a cylindrical surface sector above an electrically conductive ground plane that enhances the antenna gain. The conductive ground plane forms an integral part of the antenna, and the required dimensions of this ground plane depend on the array radius, and on the lowest elevation coverage angle from the (possibly tilted) ground plane. The antenna of the present invention is further characterized by a modular design that tailors the required antenna gain and azimuthal directivity through the stacking of identical antenna segments side by side. The idea is to use the multiple-beam ray focusing property of a microwave lens when feeding a circular ring array, and at the same time produce coherent ray imaging from a bottom metal plate, which, under appropriate conditions, will effectively double the antenna aperture in elevation.

According to the present invention there is provided, in a first preferred embodiment, a ray-imaging, electronic beam-steering antenna comprising at least one antenna segment, each antenna segment having at least one output and including a plurality of horizontally-polarized radiating arc elements and an elevation beam-forming assembly, the plurality of radiating arc elements disposed adjacently about a common axis, and an electrically conductive ground reflector plane positioned parallel to the common axis, the ground reflector plane allowing gain-enhanced, horizontal-polarization beam generation and steering in planes perpendicular to the ground reflector plane, whereby the antenna is electronically steerable in elevation, or both in elevation and in azimuth.

According to one feature of the first preferred embodiment of the antenna of the present invention, the elevation beam-forming assembly includes a two-dimensional semi-circular microwave lens with an internal perfect electric conductor reflector and a beam selector switching module.

According to another feature of the first preferred embodiment of the antenna of the present invention, the two-dimensional semi-circular microwave lens is a sector of a RKR-type lens.

According to yet another feature of the first preferred embodiment of the antenna of the present invention, the RKR-type lens is selected from the group consisting of stripline printed circuits, microstrip printed circuits and semi-circular parallel-plate microwave lens.

According to yet another feature of the first preferred embodiment of the antenna of the present invention, the two-dimensional semi-circular microwave lens is a sector of a two-dimensional Lunenberg-type microwave lens.

According to yet another feature of the first preferred embodiment of the antenna of the present invention, each two-dimensional Lunenberg-type microwave lens is implemented in a configuration selected from the group consisting of a plurality of coaxial semi-rings of varying dielectric constants, a perforated dielectric disc with a radially varying density of holes, and a plurality of dielectrically loaded parallel plates with radially varying partial loading.

According to yet another feature of the first preferred embodiment of the antenna of the present invention, the beam selector switching module includes a single-pole switching module that incorporates a passive beam conversion matrix.

According to yet another feature of the second preferred embodiment of the antenna of the present invention, the beam selection switching module includes a two-pole switch module, whereby the two-pole switch module allows both single pole selection and dual pole selection.

According to the present invention, the first preferred embodiment of the antenna of the present invention further comprises a power combiner connected electrically to the outputs of at least two antenna segments, and selected from the group consisting of a conventional power combiner, a power combiner having phase shifters, a power combiner having delay phase shifters, a Ruze-type lens, a Rotman-type lens, and any combination thereof.

According to the present invention, there is provided, in a second preferred embodiment, a ray-imaging, electronic beam-steering antenna comprising at least one antenna segment, each antenna segment having at least one output and including a plurality of vertically-polarized radiating arc elements and an elevation beam-forming assembly, the plurality of radiating arc elements disposed adjacently about a common axis, and an electrically conductive ground reflector plane positioned parallel to the common axis, the ground reflector plane allowing gain-enhanced, vertical-polarization beam generation and steering in planes perpendicular to the ground reflector plane.

According to one feature of the second preferred embodiment of the antenna of the present invention, the elevation beam-forming assembly includes a two-dimensional semi-circular microwave lens with an internal perfect magnetic conductor reflector and a beam selector switching module.

According to another feature of the second preferred embodiment of the antenna of the present invention, the two-dimensional semi-circular microwave lens is a sector of a RKR-type lens.

According to yet another feature of the second preferred embodiment of the antenna of the present invention, the RKR-type lens is selected from the group consisting of stripline printed circuits, microstrip printed circuits and semi-circular parallel-plate microwave lens.

According to yet another feature of the second preferred embodiment of the antenna of the present invention, the two-dimensional semi-circular microwave lens is a sector of a two-dimensional Lunenberg-type microwave lenses.

According to yet another feature of the second preferred embodiment of the antenna of the present invention, each two-dimensional Lunenberg-type microwave lens is implemented in a configuration selected from the group consisting of a plurality of coaxial semi-rings of varying dielectric constants, a perforated dielectric disc with a radially varying density of holes, and a plurality of dielectrically loaded parallel plates with radially varying partial loading.

According to yet another feature of the second preferred embodiment of the antenna of the present invention, the beam selector switching module includes a single-pole switching module that incorporates a passive beam conversion matrix.

According to yet another feature of the second preferred embodiment of the antenna of the present invention, the beam selection switching module includes a two-pole switch module, whereby the two-pole switch module allows both single pole selection and dual pole selection.

According to the present invention, the second preferred embodiment of the antenna of the present invention further comprises a power combiner connected electrically to the outputs of least two antenna segments, and selected from the group consisting of a conventional power combiner, a power combiner having phase shifters, a power combiner having delay phase shifters, a Ruze-type lens, a Rotman-type lens, and any combination thereof.

According to the present invention there is provided, in a third preferred embodiment, a ray-imaging, electronic beam-steering antenna comprising at least one antenna segment, each antenna segment having at least one output and including a plurality of dual-polarized radiating arc elements and an elevation beam-forming assembly, the plurality of radiating arc elements disposed adjacently along a common axis, and an electrically conductive ground reflector plane positioned parallel to the common length axis, the ground reflector plane allowing, for any polarization, gain-enhanced, beam generation and steering in planes perpendicular to the ground reflector plane.

According to one feature of the third preferred embodiment of the antenna of the present invention, the elevation beam-forming assembly includes a pair of two-dimensional semi-circular microwave lenses, one of the pair having an internal perfect electric conductor reflector, and the other of the pair having an internal perfect magnetic conductor, and a pair of beam selector switching modules, connected respectively to each of the pair of two-dimensional semi-circular microwave lenses.

According to another feature of the third preferred embodiment of the antenna of the present invention, the elevation beam-forming assembly further includes a complex weighting module connected to the pair of beam selector switching modules.

According to yet another feature of the third preferred embodiment of the antenna of the present invention, the pair of two-dimensional semi-circular microwave lenses includes a sector of a pair of RKR-type lenses.

According to yet another feature of the third preferred embodiment of the antenna of the present invention, the pair of RKR-type lenses is selected from the group consisting of stripline printed circuits, microstrip printed circuits and semi-circular parallel-plate microwave lenses.

According to yet another feature of the third preferred embodiment of the antenna of the present invention, the pair of two-dimensional semi-circular microwave lenses includes a sector of a pair of two-dimensional Lunenberg-type microwave lenses.

According to yet another feature of the third preferred embodiment of the antenna of the present invention, each lens of the pair of two-dimensional Lunenberg-type microwave lenses is implemented in a configuration selected from the group consisting of a plurality of coaxial semi-rings of varying dielectric constants, a perforated dielectric disc with a radially varying density of holes, and a plurality of dielectrically loaded parallel plates with radially varying partial loading.

According to the present invention, the third preferred embodiment of the antenna of the present invention further comprises at least one power combiner connected electrically to the outputs of least two antenna segments, the power combiner selected from the group consisting of a conventional power combiner, a power combiner having phase shifters, a power combiner having delay phase shifters, a Ruze-type lens, a Rotman-type lens, and any combination thereof.

According to yet another feature of the third preferred embodiment of the antenna of the present invention, each of the pair of beam selector switching modules includes a single-pole switching module that incorporates a passive beam conversion matrix.

According to yet another feature of the third preferred embodiment of the antenna of the present invention, each of the pair of beam selector switching modules includes a two-pole switch module, whereby the two-pole switch module allows both single pole selection and dual pole selection.

According to another version of the third preferred embodiment of the antenna of the present invention, the elevation beam-forming assembly includes a single two-dimensional microwave lens folded about a horizontal symmetry axis, and an array of 0°/180° hybrid couplers that feed the two-dimensional lens symmetrically, and a pair of beam selector switching modules, connected respectively to "sum" and "difference" ports of a sub-set of the array of 0°/180° hybrid couplers.

According to yet another feature of the third preferred embodiment of the antenna of the present invention, the two-dimensional semi-circular microwave lens includes a sector of an RKR-type lens, selected from the group consisting of stripline printed circuits, microstrip printed circuits and semi-circular parallel-plate microwave lens.

According to yet another feature of the third preferred embodiment of the antenna of the present invention, the two-dimensional semi-circular microwave lens includes a sector of a two-dimensional Lunenberg-type microwave lens.

According to yet another feature of the third preferred embodiment of the antenna of the present invention, each of the two-dimensional Lunenberg-type microwave lenses is implemented in a configuration selected from the group consisting of a plurality of coaxial semi-rings of varying dielectric constants, a perforated dielectric disc with a radially varying density of holes, and a plurality of dielectrically loaded parallel plates with radially varying partial loading.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention refers to a cylindrical ray imaging electronically steered and polarization controlled array antenna that is configured to operate in the presence of a large ground plane that enhances its directive gain. In contrast with prior art phased array antennas, whose directive gain at low elevation angles above an electrically conductive ground plane is typically highly degraded, the antenna of the present invention uses the ground plane to increase its effective aperture, thus achieving high directive gain at low elevation angles while retaining a low elevation antenna profile above the ground plane.

The antenna of the present invention may include one or several antenna sub-units that provide electronic beam steering in two dimensions: elevation and azimuth. Up to four antenna sub-units would be required for full 360° coverage in azimuth. The principles and operation of the antenna of the present invention may be better understood with reference to the drawings and the accompanying description.

The ground-plane gain-enhanced elevation beam-steering feature of this invention is preferably implemented using semi-circular, multiple-beam, modified microwave lenses. These lenses are based on either the classic RKR lens, as shown in Archer, D.: "Lens fed multiple beam arrays", Electronics Progress Raytheon, Vol. XVI, No. 4, pp. 24–32, Winter 1974 (hereinafter ARC74), or on a two-dimensional (2D) Luneberg lens as shown in Luneberg, R. K.: "Mathematical Theory of Optics", Brown University Press, Providence, 1944, pp. 189–213 (hereinafter LUN44) and in Hansen, R. C.: "Microwave scanning antennas", Vol. 1, Academic Press, New York 1963 (hereinafter HAN63).

In one preferred embodiment, azimuth beam forming simply involves the linearly stacked combination of identical antenna segments. Alternatively, if frequency insensitive electronic beam steering in azimuth is of essence, a Ruze type microwave lens (Ruze, J.: "Wide-angle metal-plate optics", Proceedings of IRE, Vol. 38, pp. 53–58, January 1950) or a Rotman type microwave lens (Rotman, W. and Turner, R. F.: "Wide-angle lens for line source applications", IEEE Transactions on Antennas and Propagation, Vol. AP-11, pp.623–632, November 1963), in conjunction with an RF switch could replace an otherwise simple azimuth power combiner.

Figure 1:
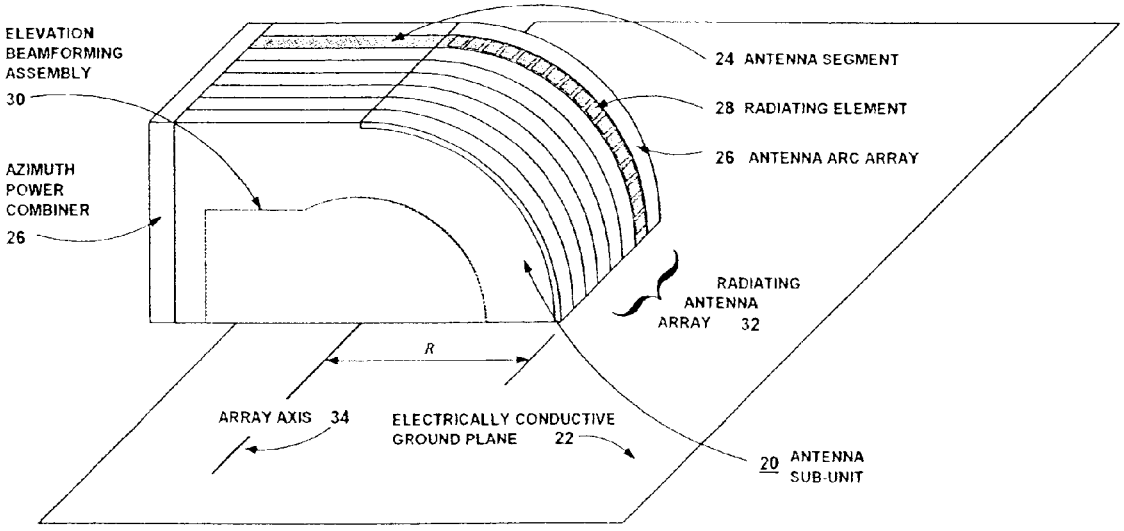
FIG. 1 is a schematic diagram describing an antenna sub-unit as an array of stacked antenna segments mounted on an extended conductive ground plane.

FIG. 1 schematically depicts a preferred embodiment of an antenna sub-unit 20 lying on an extended electrically conductive ground plane 22. We assume, without loss of generality, that ground plane 22 coincides with the azimuth (zero-elevation) plane. Antenna sub-unit 20 typically includes a plurality of linearly arrayed half-ring antenna segments 24, mounted (disposed) adjacently and lying perpendicular to ground plane 22, as well as an azimuth power combiner/divider 26. The stacking together of identical antenna segments 24 allows the antenna designer to modularly tailor the antenna dimensions parallel to the conductive ground plane to the required directive gain. Such a feature is not available in an electronically steered version of a hemispherical Luneberg lens antenna such as the DBS2400. Each antenna segment 24 includes a convex arc array 26 of vertically and horizontally-fed radiating elements 28, disposed on an arc of radius R and angular extent of 120° or less, and an elevation beam-forming assembly 30. Arc-array elements 28 of all convex arc arrays 26 form together a cylindrical array 32 having a cylindrical array axis 34 parallel to ground plane 22. The radiating elements may be implemented as dual-polarized antenna radiators with low cross-feed coupling, or as pairs of linearly polarized antenna radiators.

Figure 2:
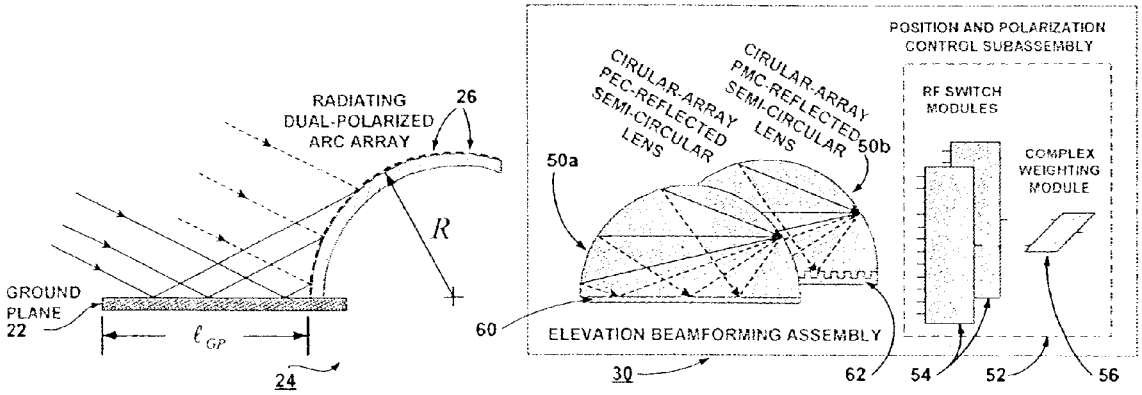
FIG. 2 is a schematic diagram describing an antenna segment as in FIG. 1, having an elevation beamforming assembly that includes a pair of PEC-reflected and PMC-reflected microwave semi-circular lenses.

FIG. 2 is a schematic diagram describing an antenna segment 24 whose elevation beamforming assembly 30 includes one or a pair of novel semi-circular lenses 50*a* or 50*b*, which are novel implementations or versions of a circular-array multiple-beam microwave lens of either RKR-type (ARC74), or 2D-Luneberg-type (LUN44 or HAN63). These are described in more detail below. In addition, elevation beamforming assembly 30 includes a position and polarization control subassembly 52. Subassembly 52 typically consists of either a single RF switch module 54 or a pair of RF switch modules 54 (one for each lens 50*a* and 50*b*), and a complex weighting module 56. Semi-circular microwave lenses 50*a*, 50*b* form the basis for the coherent ray-imaging, elevation beam-steering and polarization control capability of each antenna segment 24. Preferably, each lens 50*a* or 50*b* is a semi-circular section of a circular-array microwave lens, incorporating a perfect electric conductor (PEC) internal reflector 60 (lens 50*a* in FIG. 2) for horizontal polarization, or a lens with an internal reflecting ground plane 62 (lens 50*b* in FIG. 2) that behaves like a perfect magnetic conductor (PMC) for vertical polarization. A pair of lenses 50*a* and 50*b* allows full polarization capability.

Figure 3:
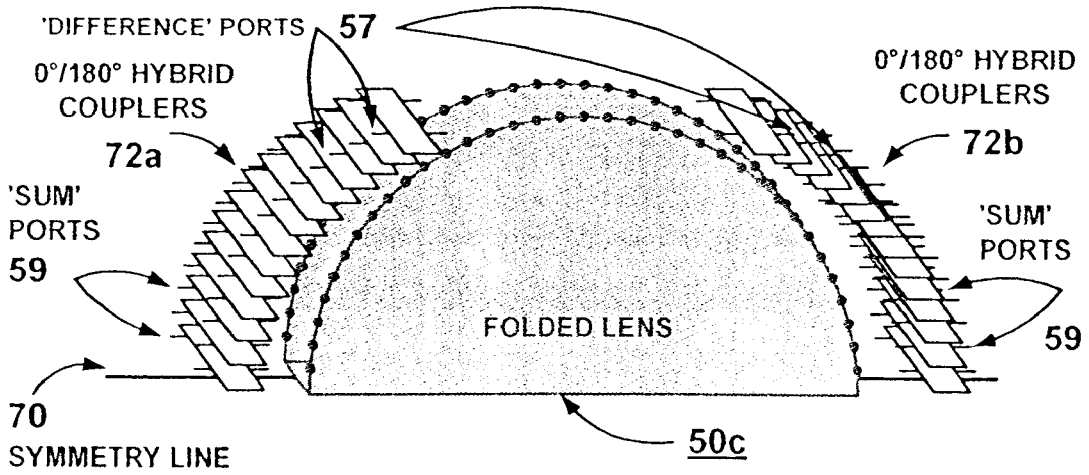
FIG. 3 is a schematic diagram that describes the use of a folded circular-array lens in conjunction with an array of 0°/180° hybrid couplers used as an alternative to a pair of PEC-reflected and PMC-reflected circular-array lenses.

Alternatively, as shown in FIG. 3, a single microwave lens 50*c* of the RKR or 2D-Luneberg type, preferably folded about a horizontal symmetry line 70, and symmetrically fed via an array of 0°/180° hybrid couplers 72*a*, 72*b*, can replace the pair of lenses 50*a*, b. Lens 50*c* may provide all the required ray-imaging feature with full polarization capability. Lens 50*c* may also be not folded.

Figure 4:
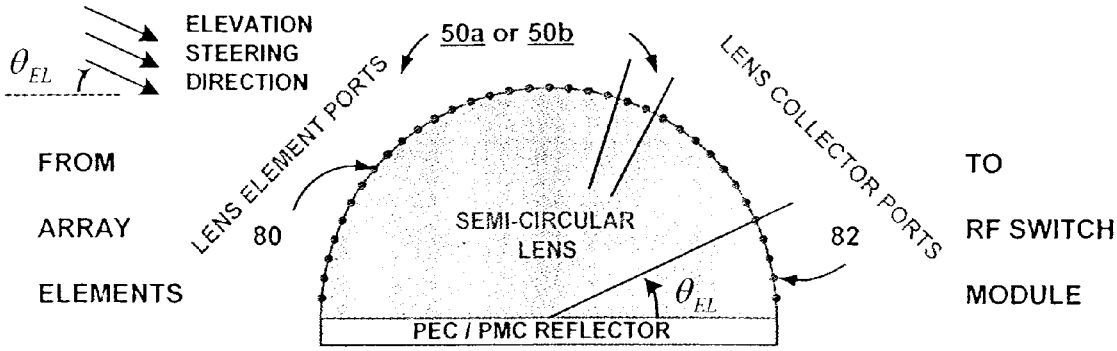
FIG. 4 is a schematic diagram that describes the allocation of microwave lens ports as element ports and as collector ports.

FIG. 4 is a schematic diagram that describes port allocation of microwave semi-circular lenses 50*a* and 50*b* as 'element ports' 80 and as 'collector ports' 82. The angular lens sector allocated as 'element ports' 80 is similar to that of the array, i.e. 120° or less in extent. Most of the other lens ports are allocated as 'collector ports' 82 whose angular location from the ground plane determines the elevation steering angle $\theta_{EL}$. The term 'collector ports' is used here in the context of a receiving antenna array; however, the same principle may be used for a transmitting array. If a lens 50*c* is used, its ports are similarly allocated into element ports 80 and collector ports 82 (not shown). The term 'collector ports' is used here in the context of a receiving antenna array; however, the same principle may be used for a transmitting array.

The radius of each lens 50 (*a, b, c*) should match the radius R of cylindrical array 32 in accordance with standard designs of lens-fed circular arrays. However, for a given electronic azimuth scan range $|\phi_{AZ}| \leqq \phi_{AZ\ max}$, where $\phi_{AZmax}$ is the maximum azimuth scan range, the lens radii should match an effective azimuth-averaged circular-array radius $(R/2)\cdot(1+\mathrm{COS}\phi_{AZmax})$ that accounts for the non-separable nature of cylindrical array co-phased radiation patterns.

Various embodiments for lenses 50 (*a, b, c*) include dielectrically loaded parallel-plate, stripline or microstrip RKR-type lenses, and dielectrically loaded parallel-plate Luneberg-type lenses. For a Luneberg lens, the required radial variation of the propagation constant may be achieved in a number of ways, including:

a) Pressed coaxial semi-rings of gradually varying dielectric constants.

b) Perforated dielectric disc with a radially varying density of holes.

c) Dielectrically loaded parallel plates with a radially varying partial loading.

PEC internal reflector 60 in lens 50*a* is typically simply a short-circuiting, electrically conductive metal plane across the lens diameter. PMC-like internal reflector 62 in lens 50*b* may be implemented as an array of internal stripline, microstrip, or waveguide elements across the lens diameter, with extended quarter-wavelength stubs short-circuited by an electrically conductive metal plane. An alternative PMC implementation may be based on a 'photonic band-gap' structure, investigated for example in A.S. Barlevy and Y. Rahmat-Samii: "Characterization of Electromagnetic Band-Gaps Composed of Multiple Periodic Tripods with Interconnecting Vias: Concept, Analysis and Design", IEEE Transactions on Antennas and Propagation, Vol. AP-49, pp. 343–353, March 2001.

Each horizontal-polarization feed line of array elements 28 is radially bridged to a respective element port of PEC-reflected lens 50*a*, whereas each vertical-polarization feed line of array element 28 is radially bridged to a respective element port of a second PMC-reflected lens 50*b*. When each pair of PEC-reflected lens 50*a* and PMC-reflected lenses 50*b* in FIG. 2 is replaced by a single lens 50*c*, symmetrically fed via an array of 0°/180° hybrid couplers 72*a*, 72*b* as in FIG. 3, then each pair consisting of a horizontal-polarization feed line and a vertical-polarization feed line from an array element is respectively bridged to the 'difference' port 57 and 'sum' port 59 of the corresponding 0°/180° hybrid coupler 72*a*.

Collector ports 82 of lenses 50*a* and 50*b* are bridged to position and polarization control subassembly 52 (FIG. 2) that serves as beam selector and interpolator in elevation, as beam positioner in azimuth, and as polarization controller. In the case of a single lens 50*c*, subassembly 52 is connected to 'difference' ports 57 and 'sum' ports 59 of the array of hybrid couplers 72*b*, bridged to collector ports 82 of the lens.

Figure 5:
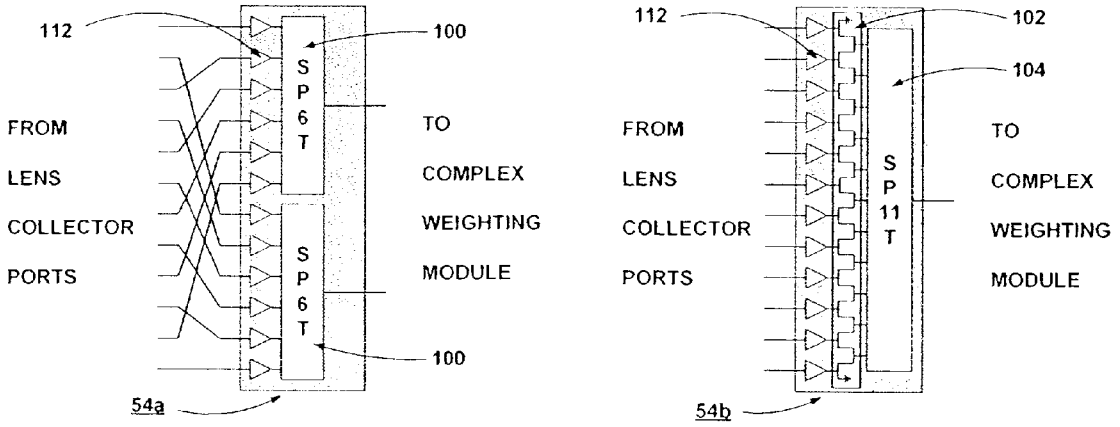
FIG. 5 is a block diagram that schematically describes two implementations for an RF switch module within the position and polarization control subassembly.

RF switch module 54 may be implemented in several ways as schematically exemplified by implementations 54*a* and 54*b* in FIG. 5. Implementation 54*a* uses two switching units 100 that respectively connect to the odd-numbered and even-numbered collector ports of lens 50*a* or 50*b* (FIG. 5) or, alternatively, to odd-numbered and even-numbered 0°/180° hybrid couplers 72*b* on the collector-port side of lens 50*c* (FIG. 3). For an SPNT RF switch module, this allows the selection of N primary lens beams together with (N−1) intermediate beams, interpolated between adjacent collector port beams, thus reducing beam intersection losses in elevation, and improving sidelobe level performance in elevation. An alternative approach for the formation of interpolated beams with reduced sidelobe level in elevation is illustrated in version 54*b* of the switch module (FIG. 5), where beam interpolation is realized with the aid of a passive conversion matrix 102 and a single switch unit 104 within the switch module. Here, only interpolated beams are available.

Figure 6:
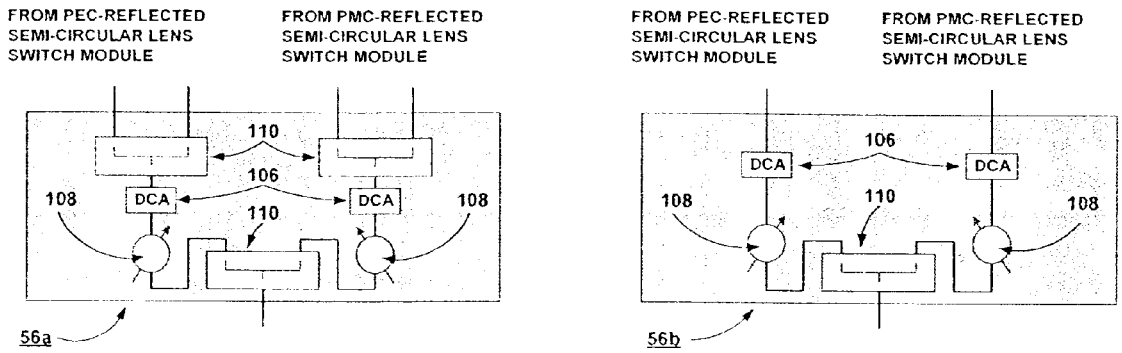
FIG. 6 is a block diagram that schematically describes two implementations of a complex weighting module within the position and polarization control subassembly.

The output ports of the two RF switch modules 54 (a pair of output ports in implementation 54*a*, a single output port in implementation 54*b* of FIG. 5) are connected, as illustrated in FIG. 5, to a complex weighting module 56 (a or b) that applies controlled attenuation and phasing on the input lines, as well as acting as an RF power combiner. As shown in FIG. 6, complex weighting module 56 may have various implementations, for example implementations 56*a* and 56*b* that correspond to implementations 54*a* and 54*b* for switch module 54. In the above two possible RF implementations of module 56, use is made of two digitally controlled attenuators (DCAs) 106, two digitally-controlled phase-shifters 108 and up to three two-way power combiners 110. Complex weighting module 56 is the key to the following antenna features:

a) Attenuation control for beam interpolation, linear polarization agility and calibration.

b) Phase control for azimuth beam steering, circular polarization agility and calibration.

Each antenna segment 24 may be configured as a passive (non-amplified) module, or alternatively in a variety of amplified architectures. These include:

a) Receiving aperture-active (low-noise amplified per array element) module.

b) Receiving beam-active (low-noise amplified per lens beam) module.

c) Transmitting aperture-active (power-amplified per array element) module.

d) Transmitting beam-active (power-amplified per lens beam) module.

e) Duplexed or T/R-switched transmitting and receiving active module (aperture-active, beam-active or polarization-active)

For example, the use of low-noise amplifiers 112 at the input ports of switch units 54*a* or 54*b* (FIG. 5) supports architecture "b" above.

The ray imaging concept of the present invention is applicable to a cylindrical antenna array mounted on an electrically conductive ground plane, and designed either for one-dimensional (1D-elevation) or two-dimensional (2D-elevation and azimuth) electronic beam steering.

Figure 7:
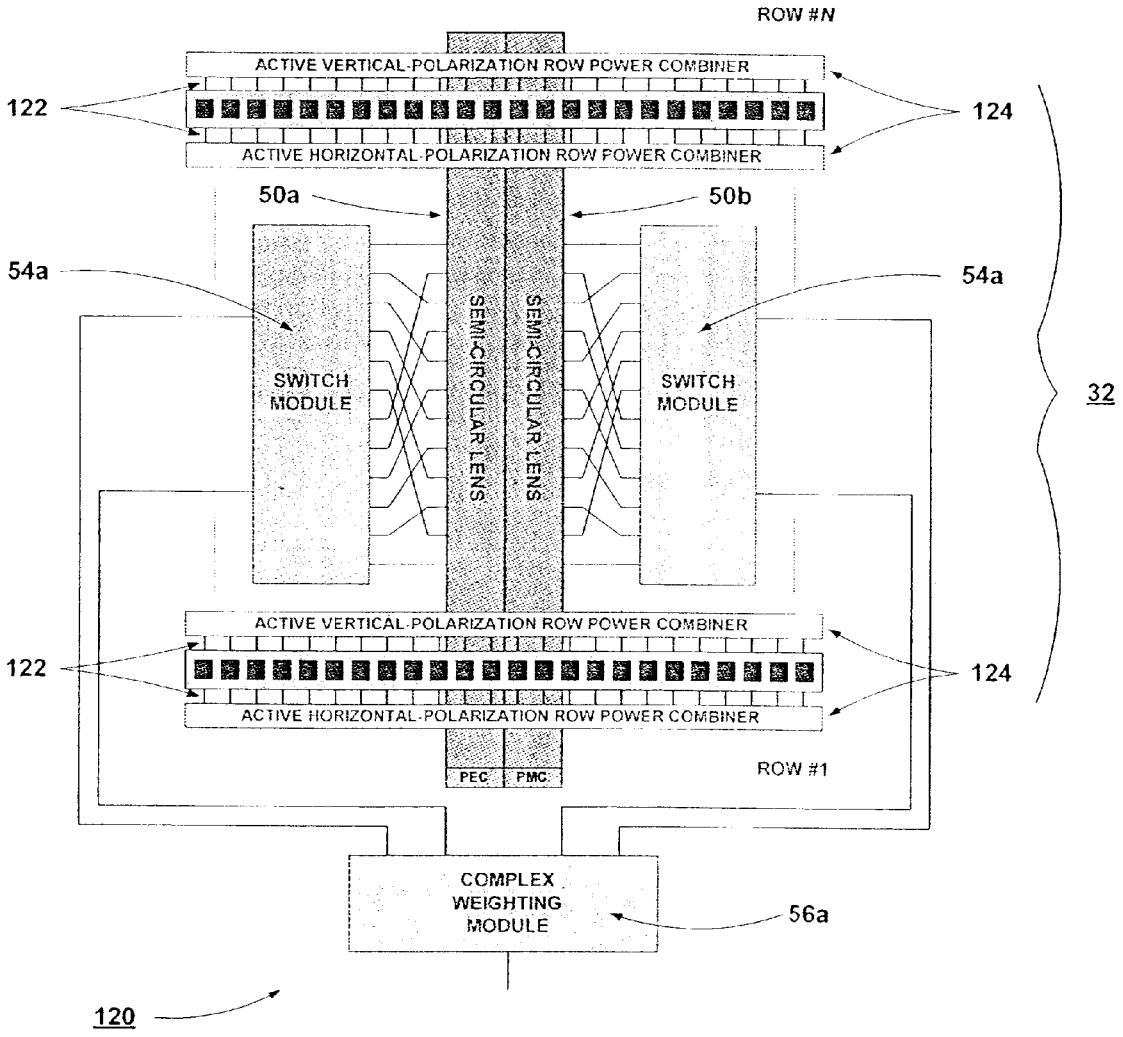
FIG. 7 is a block diagram that schematically describes the architecture of an antenna unit that may be electronically steered in elevation only.

FIG. 7 schematically depicts a possible antenna architecture for an antenna unit 120 designed for ID electronic beam steering. Here, radiating array 32 of antenna unit 120 is partitioned into rows 1 to N. Horizontal-polarization and vertical-polarization feed lines 122 from the radiating elements in each row of cylindrical array 32 are separately combined in row power combiners 124 to a pair of output lines, one for each polarization. These pairs of output lines from each array row are bridged to the appropriate lens element ports 80 of single elevation beamforming assembly 30 (FIG. 4).

Figure 8:
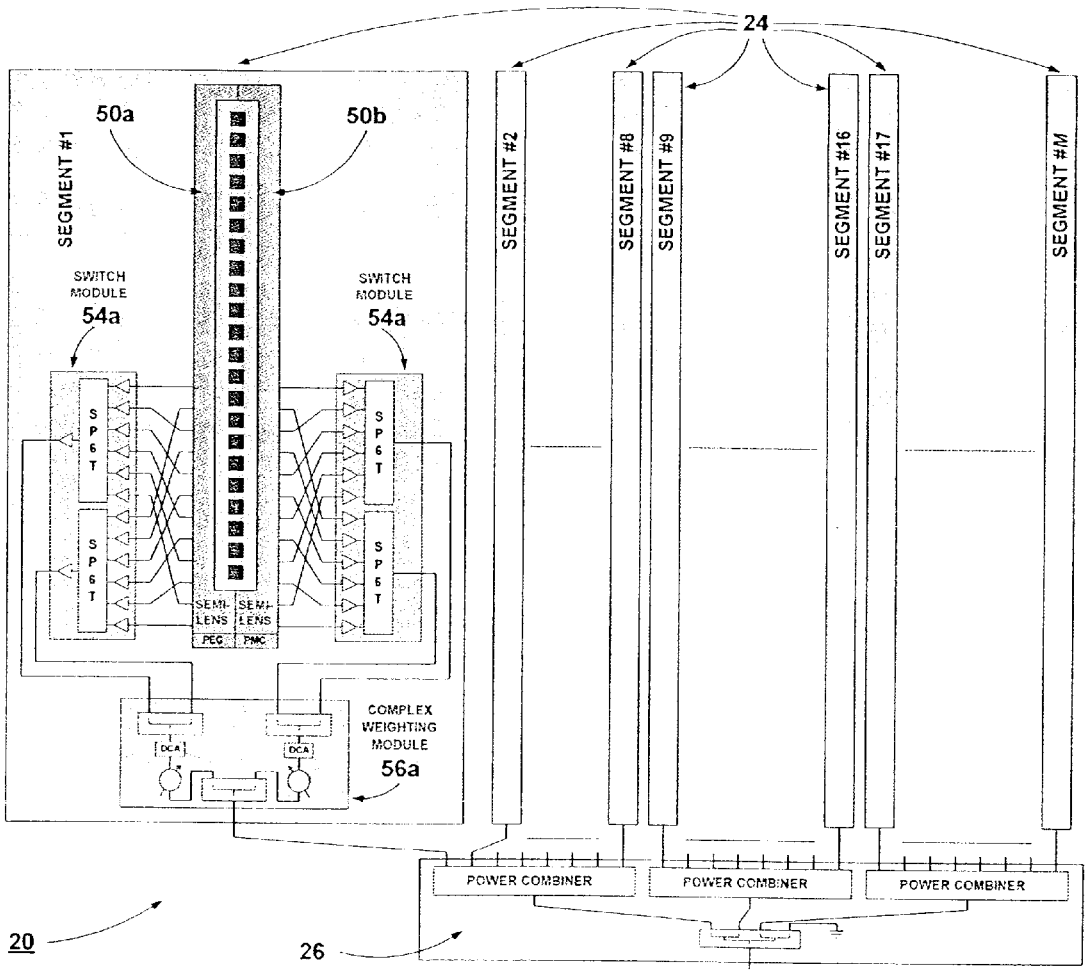
FIG. 8 is a block diagram schematically describing the architecture of an antenna unit that may be electronically steered in elevation and in azimuth.
Figure 9:
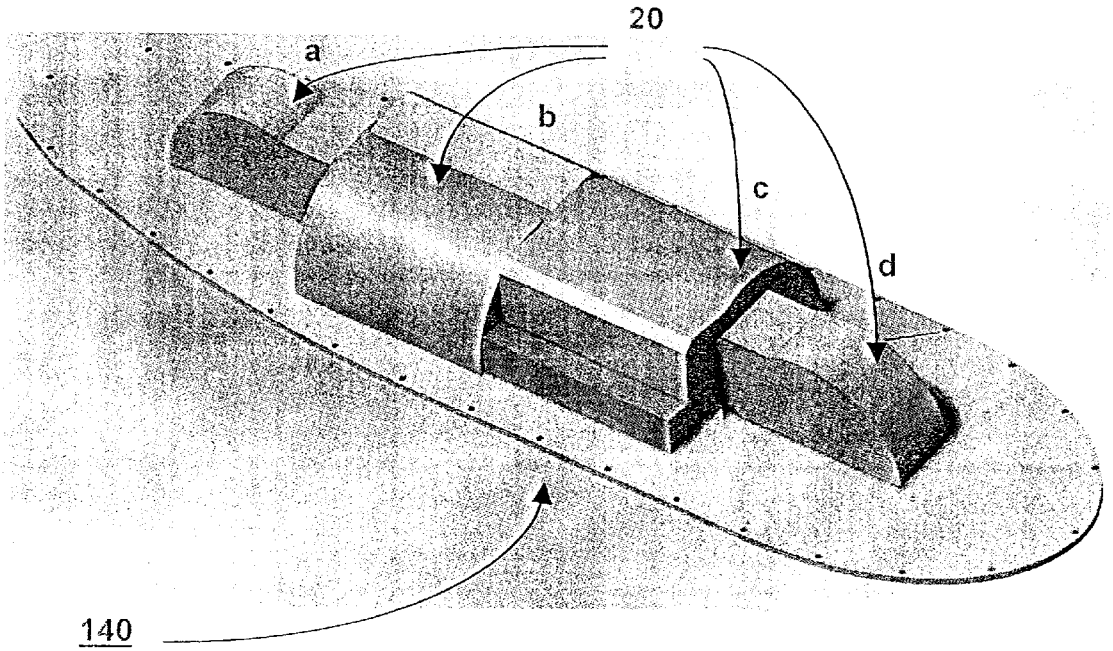
FIG. 9 is a CAD drawing describing a possible implementation of a four-unit antenna according to the present invention.

FIG. 8 schematically depicts a possible architecture for an antenna sub-unit 20 designed for 2D electronic beam steering. Here, a number of antenna segments 24 (labeled #1 to #$\mu$M are linearly stacked together in azimuth, and their outputs combined in power combiner 26. An antenna 140 comprising three to four selectable sub-units 20 will be able to provide full 360°-azimuth coverage, as exemplified by 20*a–d* in the CAD drawing of FIG. 9.

Electrically conductive plane 22 forms an integral part of each antenna sub-unit 20 in that electric currents on plane 22 represent a mirror image of the antenna sub-unit, enhancing the effective area of the physical antenna sub-unit above the plane. The required dimensions of electrically conductive plane 22 depend on the radius R of cylindrical radiating array 32 (FIGS. 1, 2), and on the lowest sought elevation coverage angle $\theta_{ELmin}$ from the (possibly tilted) ground plane 22. When antenna sub-units 20 are mounted on top of a large airborne platform such as a passenger airplane, as shown in FIG. 10, external imaging plates 150 must also be installed in juxtaposition to the antenna as extensions to electrically conductive planes 22.

Figure 10:
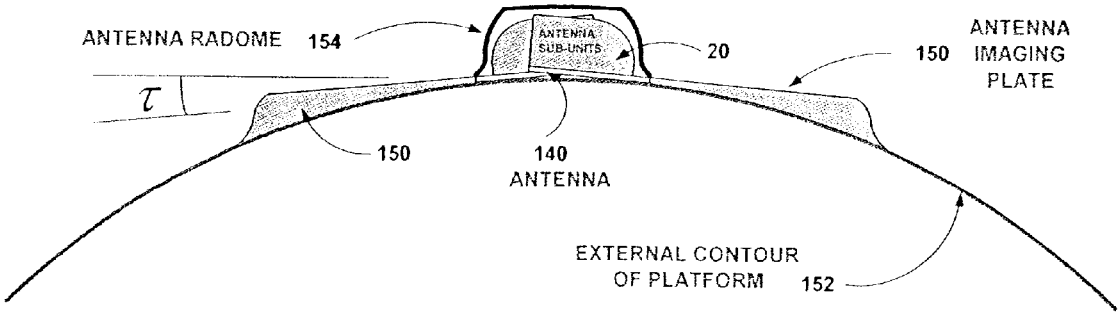
FIG. 10 is a schematic diagram that describes the use of imaging plates externally fitted on an airplane fuselage, in juxtaposition to a top-mounted ray imaging antenna.

FIG. 10 is a schematic diagram that describes the use of imaging plates 150 externally fitted on an airplane fuselage contour or platform 152, in juxtaposition to a top-mounted ray imaging antenna 140, comprising several antenna sub-units 20, and shown here with an antenna radome 154. External imaging plates 150 must provide an extended ground plane of adequate extent and a predetermined tilt angle, commensurate with a similar tilt of antenna sub-units 20, which reduces the minimum elevation coverage angle $\theta_{ELmin}$ without resorting to an oversized extended ground plane. If a minimum elevation coverage angle of $\theta_{ELmin}$ above the horizon is sought, and $\tau$ is the tilt angle of the ground plane (FIG. 10), the required extent $l_{GP}$ (FIG. 2) of the ground plane from the array 32 is given by:

$$l_{GP} \geq R \cdot [COSEC(\theta_{ELmin}+\tau)-1]$$

Principle of Operation

On "receive", a planar wave-front impinging on an antenna segment 24 and the electrically conductive ground plane 22 at some angle $\theta_{EL}$ above the said ground plane, will be received by the elements of cylindrical array 32 as the respective sum and difference for vertically polarized and horizontally polarized plane waves, of incident contributions from $+\theta_{EL}$ and $-\theta_{EL}$ above the ground plane.

In an antenna segment 24 containing a semi-circular lens 50*a* with an internal PEC reflector 60 and a semi-circular lens 50*b* with an internal PMC-like reflector 62, the excited element ports 80 in each of the two lenses 50*a*, 50*b* will focus their signals onto one lens collector port 82 in each lens, or in-between two adjacent collector ports, by virtue of two coherent contributions:

A direct internal contribution originating from the externally reflected plane-wave field component incident at $-\theta_{EL}$. The external reflection from ground plane 22 will introduce an extra electrical phase shift of 180° to the horizontally polarized component only.

An internally reflected contribution originating from the direct external plane-wave field component incident at $+\theta_{EL}$. The horizontally polarized component is directed to lens 50*a* with internal PEC reflector 60. Due to the internal horizontal polarization of stripline, microstrip or parallel-plate lenses, an electrical phase shift of 180° will be introduced by the reflection. The vertically polarized component is directed to lens 50*b* with internal PMC reflector 62. Consequently, no extra phase shift will be introduced by the reflection.

Both Vertical-polarization components therefore add in phase at a collector port 82 of a PMC-reflected lens 50*b* (no electrical phase shift by reflection), and both Horizontal-polarization components add in phase at a collector port 82 of a PEC-reflected lens 50*a* (180° electrical phase shift by each reflection). These collector ports are selectable by switch modules 54*a* or 54*b*. Phase-shifters 108 (FIG. 6) within the complex weighting module 56*a* or 56*b* may be used to compensate for the extra 180° phase shift, as well as for the introduction of additional phase-shifts for the reception/transmission of circular polarization, for beam steering in azimuth, and for the correction of phase errors. DCAs 106 within complex weighting module 56*a* or 56*b* (FIG. 6) provide the means to receive or transmit slant linear or elliptical polarization, and to correct for amplitude errors.

In an antenna segment 24 containing a single, preferably folded microwave lens 50*c* whose element ports 80 and collector ports 82 are symmetrically combined by corresponding arrays of 0°/180° hybrid couplers 72*a* and 72*b*, there will be four contributions to consider:

A vertical-polarization contribution emanating from the externally reflected plane-wave field component, incident at $-\theta_{EL}$. This component, which does not suffer an extra 180° phase shift, is directed to the 'sum' ports of element-port 0°/180° hybrid coupler array 72*a*, generating a pair of co-phased internal wave-fronts that travel towards a pair of symmetric collector ports of the lens. The signals delivered to these collector ports by the aforementioned wavefronts are then combined by a 0°/180° collector-port hybrid coupler 72*b* that will direct the combined signal to its 'sum' port.

A horizontal-polarization contribution emanating from the externally reflected plane-wave field component, incident at $-\theta_{EL}$. This component, which suffers an extra 180° phase shift, is directed to the 'difference' ports of element-port 0°/180° hybrid coupler array 72*a*, generating a pair of anti-phased internal wave-fronts that travel towards a pair of symmetric beam ports of the lens. The signals delivered to these collector ports by the aforementioned wavefronts are then combined by a 0°/180° collector-port hybrid coupler 72*b* that will direct the combined signal to its 'difference' port.

A vertical-polarization contribution emanating from the direct external plane-wave field component incident at $+\theta_{EL}$. This direct component is directed to the 'sum' ports of element-port 0°/180° hybrid coupler array 72*a*, generating a pair of co-phased internal wave-fronts that travel towards a pair of symmetric beam ports of the lens. The signals delivered to these collector ports by the aforementioned wavefronts are then combined by a 0°/180° collector-port hybrid coupler 72*b* that will direct the combined signal to its 'sum' port.

A horizontal-polarization contribution emanating from the direct external plane-wave field component incident at $+\theta_{EL}$. This direct component is directed to the 'difference' ports of element-port 0/180° hybrid coupler array 72*a*, generating a pair of anti-phased internal wave-fronts that travel towards a pair of symmetric beam ports of the lens. The signals delivered to these collector ports by the aforementioned wavefronts are then combined by a 0°/180° collector-port hybrid coupler 72*b* that will direct the combined signal to its 'difference' port.

Note that both vertical-polarization components (direct and externally reflected) generate co-phased internal wave-front inside lens 50*c*, and are therefore coherently combined at the 'sum' output of the appropriate collector-port 0°/180° hybrid coupler unit. In contrast, the horizontal-polarization components always generate internal anti-phased wave fronts inside the lens. Although the externally reflected horizontal-polarization component suffers an extra 180° phase-shift, this is compensated by an additional anti-phasing introduced by the seemingly opposite directions of incidence ($-\theta_{EL}$ and $+\theta_{EL}$).

Here too, complex weighting module 56*a* or 56*b* is used to generate a weighted linear combination of vertical-polarization and horizontal-polarization components for full polarization agility, as well as provide a means for steering in azimuth and correction of amplitude and/or phase errors.

Although the principle of operation was discussed for a receiving antenna unit, it equally applies for a transmitting unit.

All publications, patents and patent applications mentioned in this application are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

While the invention has been described with respect to a limited number of embodiments, it will be appreciated that many variations, modifications and other applications of the invention may be made.

What is claimed is:

1. A ray-imaging, electronic beam-steering antenna comprising:

a. at least one antenna segment, each said at least one antenna segment having at least one output and including a plurality of horizontally-polarized radiating arc elements and an elevation beam-forming assembly, said plurality of radiating arc elements disposed adjacently about a common axis, wherein said elevation beam-forming assembly includes a two-dimensional semi-circular microwave lens with an internal perfect electric conductor reflector and a beam selector switching module, and b. an electrically conductive ground reflector plane positioned parallel to said common axis, said ground reflector plane allowing gain-enhanced, horizontal-polarization beam generation and steering in planes perpendicular to said ground reflector plane.

2. The antenna of claim 1, wherein said two-dimensional semi-circular microwave lens includes a sector of a RKR-type lens.

3. The antenna of claim 2, wherein said RKR-type lens is selected from the group consisting of stripline printed circuits, microstrip printed circuits and semi-circular parallel-plate microwave lens.

4. The antenna of claim 1, wherein said two-dimensional semi-circular microwave lens includes a sector of a two-dimensional Lunenberg-type microwave lens.

5. The antenna of claim 4, said two-dimensional Lunenberg-type microwave lens is implemented in a configuration selected from the group consisting of a plurality of coaxial semi-rings of varying dielectric constants, a perforated dielectric disc with a radially varying density of holes, and a plurality of dielectrically loaded parallel plates with radially varying partial loading.

6. The antenna of claim 1, further comprising a power combiner connected electrically to said at least one output of at least two of said antenna segments.

7. The antenna of claim 6, wherein said power combiner is selected from the group consisting of a conventional power combiner, a power combiner having phase shifters, a power combiner having delay phase shifters, a Ruze-type lens, a Rothman-type lens, and any combination thereof.

8. The antenna of claim 1, wherein said beam selector switching module includes a single-pole switching module that incorporates a passive beam conversion matrix.

9. The antenna of claim 1, wherein said beam selector switching module includes a two-pole switch module, whereby said two-pole switch module allows both single pole selection and dual pole selection.

10. A ray-imaging, electronic beam-steering antenna comprising:

a. at least one antenna segment, each said at least one antenna segment having at least one output and including a plurality of vertically-polarized radiating arc elements and an elevation beam-forming assembly, said plurality of radiating arc elements disposed adjacently about a common axis, wherein said elevation beam-forming assembly includes a two-dimensional semi-circular microwave lens with an internal perfect magnetic conductor reflector and a beam selector switching module, and b. an electrically conductive ground reflector plane positioned parallel to said common axis, said ground reflector plane allowing gain-enhanced vertical-polarization beam generation and steering in planes perpendicular to said ground reflector plane.

11. The antenna of claim 10, wherein said two-dimensional semi-circular microwave lens includes a sector of an RKR type lens.

12. The antenna of claim 11, wherein said RKR type lens is selected from the group consisting of stripline printed circuits, microstrip printed circuits and semi-circular parallel-plate microwave lens.

13. The antenna of claim 10, wherein said two-dimensional semi-circular microwave lens includes a sector of a two-dimensional Lunenberg-type microwave lens.

14. The antenna of claim 13, wherein each said two-dimensional Lunenberg-type microwave lens is implemented in a configuration selected from the group consisting of a plurality of coaxial semi-rings of varying dielectric constants, a perforated dielectric disc with a radially varying density of holes, and a plurality of dielectrically loaded parallel plates with radially varying partial loading.

15. The antenna of claim 10, wherein said beam selector switching module includes a single-pole switching module that incorporates a passive beam conversion matrix.

16. The antenna of claim 10, wherein said beam selector switching module includes a two-pole switch module, whereby said two-pole switch module allows both single pole selection and dual pole selection.

17. The antenna of claim 10, further comprising a power combiner connected electrically to said at least one output of at least two of said antenna segments.

18. The antenna of claim 17, wherein said power combiner is selected from the group consisting of a conventional power combiner, a power combiner having phase shifters, a power combiner having delay phase shifters, a Ruze-type lens, a Rothman-type lens, and any combination thereof.

19. A ray-imaging, electronic beam-steering antenna comprising:

a. at least one antenna segment, each said at least one antenna segment having at least one output and including a plurality of dual-polarized radiating arc elements and an elevation beam-forming assembly, said plurality of radiating arc elements disposed adjacently along a common axis, wherein said elevation beam-forming assembly includes:

i. a pair of two-dimensional semi-circular microwave lenses, one of said pair having an internal perfect electric conductor reflector, and the other of said pair having an internal perfect magnetic conductor, and ii. a pair of beam selector switching modules, connected respectively to each of said pair of two-dimensional semi-circular microwave lenses, and b. an electrically conductive ground reflector plane positioned parallel to said common length axis, said ground reflector plane allowing, for any polarization, gain-enhanced, beam generation and steering in planes perpendicular to said ground reflector plane.

20. The antenna of claim 19, wherein said elevation beam-forming assembly further includes a complex weighting module connected to said pair of beam selector switching modules.

21. The antenna of claim 19, wherein said pair of two-dimensional semi-circular microwave lenses includes a sector of a pair of RKR-type lenses.

22. The antenna of claim 21, wherein said pair of RKR-type lenses is selected from the group consisting of stripline printed circuits, microstrip printed circuits and semi-circular parallel-plate microwave lenses.

23. The antenna of claim 19, wherein said pair of two-dimensional semi-circular microwave lenses includes a sector of a pair of two-dimensional Lunenberg-type microwave lenses.

24. The antenna of claim 23, wherein each of said pair of two-dimensional Lunenberg-type microwave lenses is implemented in a configuration selected from the group consisting of a plurality of coaxial semi-rings of varying dielectric constants, a perforated dielectric disc with a radially varying density of holes, and a plurality of dielectrically loaded parallel plates with radially varying partial loading.

25. The antenna of claim 19, further comprising at least one power combiner connected electrically to said at least one output of at least two of said antenna segments.

26. The antenna of claim 25, wherein said power combiner is selected from the group consisting of a conventional power combiner, a power combiner having phase shifters, a power combiner having delay phase shifters, a Ruze-type lens, a Rothman-type lens, and any combination thereof.

27. The antenna of claim 19, wherein each of said pair of beam selector switching modules includes a single-pole switching module that incorporates a passive beam conversion matrix.

28. The antenna of claim 19, wherein each of said pair of beam selector switching modules includes a two-pole switch module, whereby said two-pole switch module allows both single pole selection and dual pole selection.

29. A ray-imaging electronic beam-steering antenna comprising:

a. at least one antenna segment, each said at least one antenna segment having at least one output and including a plurality of dual-polarized radiating arc elements and an elevation beam-forming assembly, said plurality of radiating arc elements disposed adjacently along a common axis, wherein said elevation beam-forming assembly includes:

i. a single two-dimensional microwave lens folded about a horizontal symmetry axis, and an array of 0°/180° hybrid couplers that feed said two-dimensional lens symmetrically, and ii. a pair of beam selector switching modules, connected respectively to "sum" and "difference" ports of a subset of said array of 0°/180° hybrid couplers', and b. an electrically conductive ground reflector plane positioned parallel to said common length axis, said ground reflector plane allowing, for any polarization, gain-enhanced, beam generation and steering in planes perpendicular to said ground reflector plane.

30. The antenna of claim 29, wherein said elevation beam-forming assembly further includes a complex weighting module connected to said pair of beam selector switching modules.

31. The antenna of claim 30 wherein said two-dimensional semi-circular microwave lens includes a sector of an RKR-type lens.

32. The antenna of claim 31, wherein said RKR-ivpe lens is selected from the group consisting of stripline printed circuits, microstrip printed circuits and semi-circular parallel-plate microwave lens.

33. The antenna of claim 30, wherein said two-dimensional semi-circular microwave lens includes a sector of a two-dimensional Lunenberg-type microwave lens.

34. The antenna of claim 33, wherein each said two-dimensional Lunenberg-type microwave lens is implemented in a configuration selected from the group consisting of a plurality of coaxial semi-rings of varying dielectric constants, a perforated dielectric disc with a radially varying density of holes, and a plurality of dielectrically loaded parallel plates with radially varying partial loading.

35. The antenna of claim 29, further comprising at least one power combiner connected electrically to said at least one output of at least two of said antenna segments.

36. The antenna of claim 35, wherein said power combiner is selected from the group consisting of a conventional power combiner, a power combiner having phase shifters, a power combiner having delay phase shifters, a Ruze-type lens, a Rothman-type lens, and any combination thereof.

37. The antenna of claim 29, wherein each of said pair of beam selector switching modules includes a single-pole switching module that incorporates a passive beam conversion matrix.

38. The antenna of claim 29, wherein each of said pair of beam selector switching modules includes a two-pole switch module, whereby said two-pole switch module allows both single pole selection and dual pole selection.

* * * * *